US005193296A

United States Patent [19]

Reilley

[11] Patent Number: 5,193,296

[45] Date of Patent: Mar. 16, 1993

[54] SNOW PLOW ATTACHMENT

[76] Inventor: Peter V. Reilley, 19 Heritage Cir., Hudson, N.H. 03051

[21] Appl. No.: 775,565

[22] Filed: Oct. 15, 1991

[51] Int. Cl.[5] ..... E01H 5/04

[52] U.S. Cl. ..... 37/231; 37/234; 37/236; 37/271

[58] Field of Search ..... 37/231, 234, 235, 236, 37/266, 270, 271

[56] References Cited

U.S. PATENT DOCUMENTS 3,987,562 10/1976 Deen et al. ..... 37/231
4,236,329 12/1980 Hetrick ..... 37/231
4,304,056 12/1981 Watson et al. ..... 37/231 X
4,342,163 8/1982 Hoekstra ..... 37/231
4,619,060 10/1986 Knowlton ..... 37/231
4,821,435 4/1989 Pester ..... 37/231
4,962,599 10/1990 Harris ..... 37/231 X
4,976,053 12/1990 Caley ..... 37/231

*Primary Examiner*—Randolph A. Reese
*Assistant Examiner*—J. Russell McBee
*Attorney, Agent, or Firm*—Iandiorio & Dingman

[57] ABSTRACT

A novel means of attaching a plow frame to a vehicle frame is described. The attachment means includes ears on both the plow frame and the vehicle frame. The ears are joined together by pins that are inserted through holes in the ears. The ears are shaped in such a way that they can be forced into alignment using the plow's lifting device. When the ears are held in alignment this way the coupling pins can be easily inserted. This greatly eases the coupling of the plow to the vehicle.

4 Claims, 3 Drawing Sheets

SNOW PLOW ATTACHMENT

This invention is an improvement to the method by which snow plows and the like are attached to a vehicle. More simply it is an improved attachment mechanism that greatly reduces the muscle work necessary to attach and detach the plow.

BACKGROUND OF THE INVENTION

Most snow plows are attached to the propelling vehicle by hinge device that allows the plow to move up and down freely. The plow also must be removable so that it can be detached when it is not needed. The prior art and common practice is to engage the plow frame to the vehicle by means of two pins that must be manually inserted though a set of mating ears on the plow frame and on the vehicle.

This provides a rugged and secure method of attachment. The primary problem with this design is that it is very difficult to align the sets of ears sufficiently accurately that the pins can be inserted. Generally the plow must be moved back and forth manually until the holes align. This is quite difficult because even the lightest plows weigh over 300 pounds. The person must move the plow while at the same time attempting to insert the pin. The plow must be precisely aligned in 4 of the six positional dimensions. It must be aligned in vertical and forward and back linear dimensions and roll and yaw rotational dimensions. The alignment must be made to better than 1/32 of an inch in most cases. The two other dimensions (side to side and pitch) need not be aligned as well.

When the plow is to be detached it can be quite difficult to remove the pins. This is because the weight of the plow is resting on the pins.

The prior art has understood this problem and proposed some solutions. Referenced patents;

(a) U.S. Pat. No. 4,962,599 to Harris.
(b) U.S. Pat. No. 3,987,562 to Deen et al.
(c) U.S. Pat. No. 4,205,825 to Stanford.
(d) U.S. Pat. No. 4,821,435 to Pester.
(e) U.S. Pat. No. 4,342,163 to Hoekstra.

Harris describes a means of attachment that will automatically latch the plow frame to the vehicle frame when vehicle is moved forward against the plow frame. The latching action is made as a result of two spring loaded pins. The spring being released when plow frame and vehicle frame come together. This is a variation on the current practice and when attached, the joint will be strong and reliable.

This mechanism has the effect of reducing the accuracy that the plow needs to be aligned when mating to the vehicle. The forward dimension is taken up by moving the vehicle forward into the plow. The remaining three dimensions will be forced into alignment to a small degree by the tapered entry into the latch.

This mechanism has several disadvantages. The first is that it is relatively complicated. Such complication would cost considerably more than the standard hitch. The mechanism could be damaged if the plow were not well aligned before mating was attempted. This device provides no help in detaching the plow, the pins must be removed against the plow's weight. The plow frame must be held up from the floor manually to enable coupling.

Deen et al. show another automatic attachment device. This device is a jaw that grips a pin fixed to the vehicle frame. The jaw is shaped such that when it is struck by the pin during the attachment operation it will rotate to the closed position. The coupling is completed by the operator moving two levers to the latched position and securing them by means of a lock pin.

Like the Harris design, this mechanism has the effect of reducing the accuracy that the plow needs to be aligned when mating to the vehicle. The forward dimension is taken up by moving the vehicle forward into the plow. The remaining three dimensions will be forced into alignment to a small degree by the tapered entry into the latch.

The disadvantages of this mechanism are complexity and cost. This mechanism is also more complicated and therefore more costly than the standard coupling. It can be made rugged enough with the use of sufficiently strong parts. The plow frame must be held up from the floor manually to enable coupling.

Stanford addresses the problem of adjusting the height of the plow frame so as to align it with the vehicle frame. He proposes a screw jack that is attached to the plow frame and can be used to raise or lower the plow frame as needed. This device is used to align the plow frame in the vertical dimension.

The disadvantages of this invention are that it does nothing for alignment in the three other dimensions that must be done before coupling can be completed. There is some cost and additional complexity associated with the device.

Pester describes a device that acts as a carriage for the plow when it is not attached to the vehicle. This device should allow the accurate positioning of the plow frame to the vehicle frame with a minimum of muscle power. It encompasses a screw jack for raising the plow frame in the vertical dimension. There are castor wheels that would allow positioning the plow frame in the two rotational dimensions and the forward dimension.

The principle disadvantage of this device is that it requires a hard flat surface to roll upon. Snow plows are often left outside until needed. This means that they are covered with snow and ice and resting on frozen mud when needed. This device would be useless in these conditions. There is also the issue of the additional cost. Since the device is not attached to the plow it could get lost or stolen.

Hoekstra discloses a plow attachment method that uses the plow's lifting device to lower the plow frame onto a pin that is mounted on the vehicle frame. The plow frame ears have a slot that engages the pin on the vehicle frame. The joint secured by a second pin that is inserted above the coupling pin. This second pin prevents the plow frame lifting off the coupling pin during use.

This design produces a weaker joint that one with holes in the ears rather than slots. The slots can be forced opened by rough use. The plow is attached loosely by this method, the plow frame can move up and down the slots during use. This can result in damage to the ears.

The use of the lifting device aids in aligning the plow frame in the vertical direction and in the roll rotational dimension. The device does not aid in aligning the forward and back dimension or in the yaw rotational dimension. Therefore, the operator must manually move the plow into alignment before the slots will align with the pins. This can require considerable muscle power.

BRIEF DESCRIPTION OF THE PREFERRED EMBODIMENT

The invention is a specially designed coupling that holds the plow frame in alignment with the vehicle frame such that the mating pins can be easily inserted. The power necessary to hold the plow frame in this position comes from the plow's hydraulic system. The normal lifting cylinder is used to lift the plow frame into position. The special coupling will hold the precise alignment until the coupling pin is inserted. An external control that allows the user to raise and lower the hydraulic lift would make the invention even easier to use.

DESCRIPTION OF THE PREFERRED EMBODIMENT OF THE INVENTION

Figure 1:
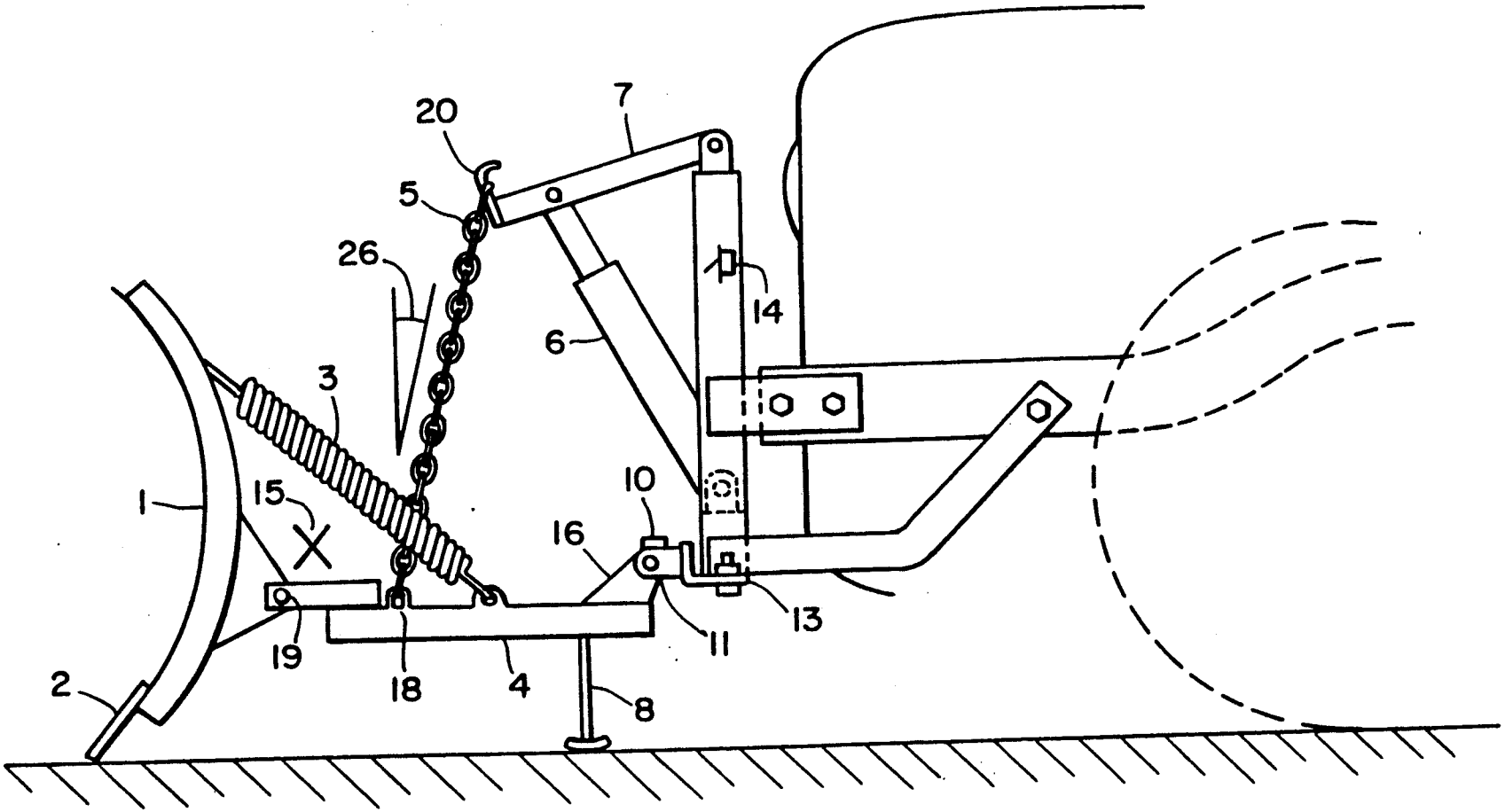
FIG. 1 shows a side view plow attached to a truck.
Figure 2:
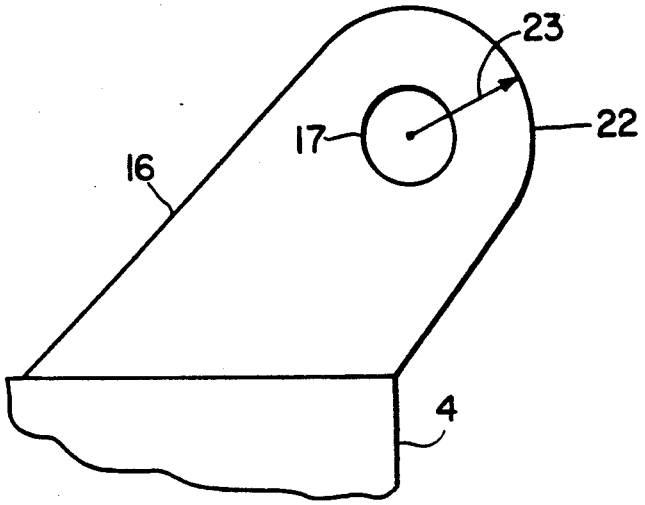
FIG. 2 shows the connecting ear of the plow frame.
Figure 3:
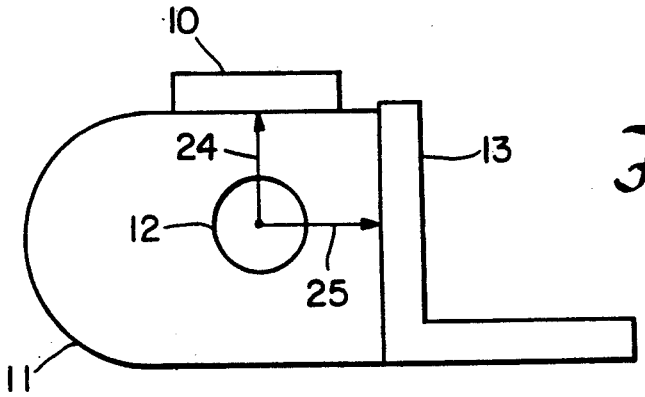
FIG. 3 shows the connecting ear of the vehicle frame.
Figure 4:
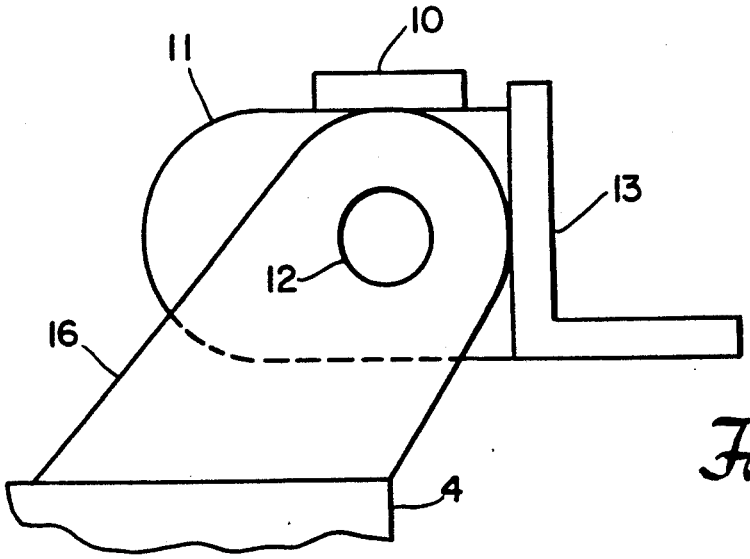
FIG. 4 shows a view of the plow frame connecting ear mated with a cut away view of the vehicle frame connecting ear.
Figure 5:
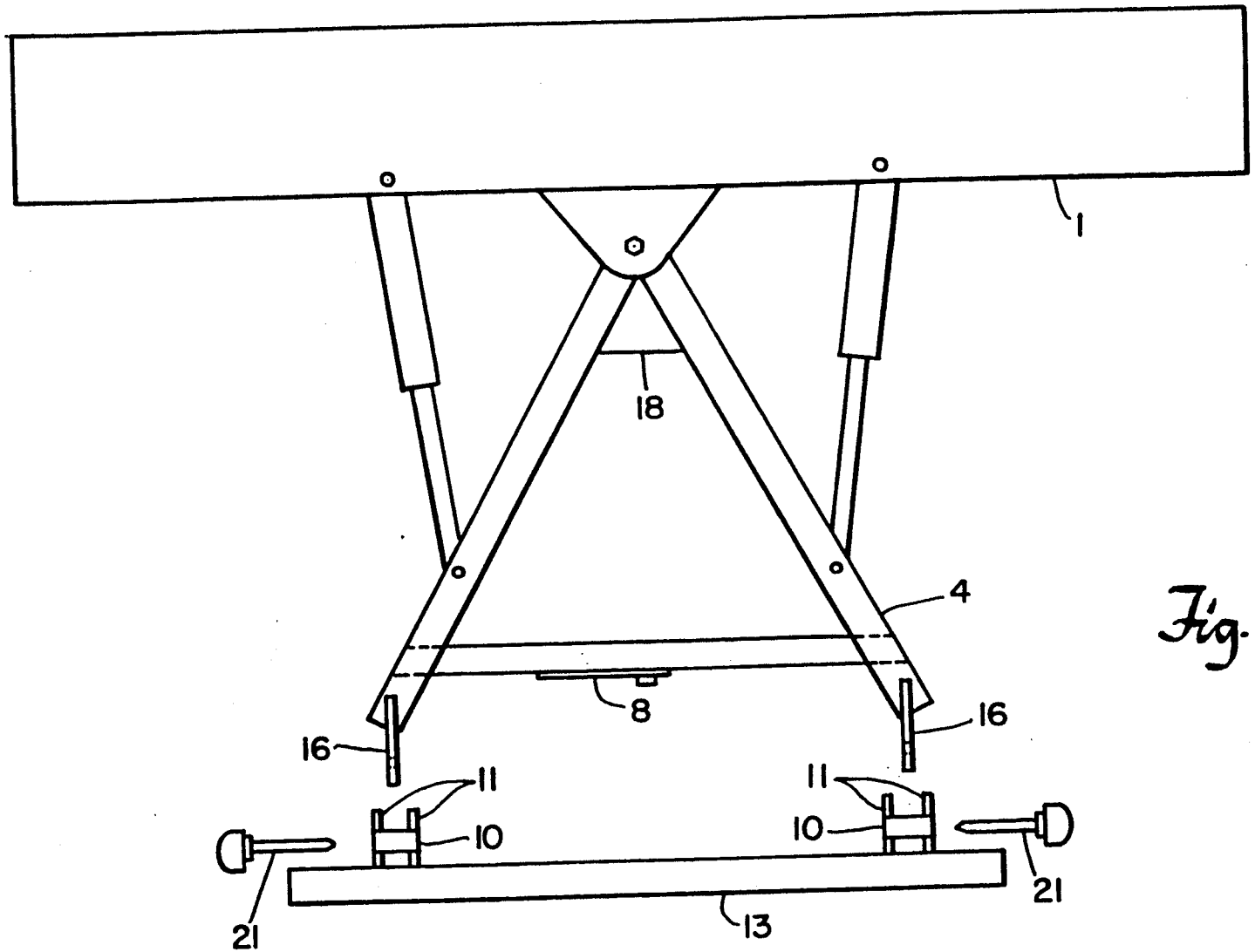
FIG. 5 shows a top view of the plow frame with the support member swung out of the way.

A snow plow includes a mold board 1 with a replaceable scraper blade 2 and a plow frame 4. The mold board 1 is attached to the plow frame 4 by a rotatable joint 19. The springs 3 act to hold the mold board 1 in the upright position. If the scraper blade 2 strikes a fixed object during plowing, the mold board 1 will fold downward thereby allowing the plow to skip over the object and avoid damage. The springs 3 will act to restore the plow to it's normal position.

The plow frame 4 includes two ears 16 that are used to attach the plow to the vehicle frame 13. The vehicle frame includes a lifting device 6. Often the lifting device 6 is a hydraulic cylinder. The lifting device 6 is attached to a lever 7 that has a means of attaching to a chain 5. The other end of the chain 5 is attached to the plow frame 4 at attachment point 18 and is the means of lifting the plow. The vehicle frame 13 has two sets of ears 11 that mate with the ears 16 of the plow frame. The mating is accomplished with two pins 21 that are manually inserted through the holes in the both sets of ears 11 and 16.

There can be an external control 14 that allows raising and lowering the lifting device 6. This would make mating the plow easier. There also can be a foot 8 that would hold the plow frame 4 up off the ground. This is also an aid to mating the plow.

The novel part of the described plow attachment is in the design of the coupling ears 11 and 16. The design of the ears works in conjunction with proper location of the lifting chain 5 and it's attachment point 18 to the plow frame 4.

The plow frame ear 16 should be shaped such that curved portion 22 be at a specific radius 23 with respect to the center of the coupling pin hole 17. The vehicle frame ears should be formed such that the center of the coupling hole be a distance 25 away from the vehicle frame bar 13. This distance 25 should be equal to the plow frame radius 23. There should be a metal stop 10 that is welded to the top of both pairs of vehicle frame ears 11. The distance 24 from the center of the coupling pin holes to the metal stop is the same as the plow frame radius 23.

This construction causes the coupling pin holes 17 in the plow frame ears 16 to be held in alignment with the coupling pin holes 12 in the vehicle frame ears 11 when the plow frame 4 is lifted up and forced toward the vehicle frame 13. With the coupling pin holes 12, 17 held in alignment the coupling pins 21 can be inserted easily.

The force that lifts the plow frame 4 and forces it toward the vehicle frame is generated by the lifting device 6 acting on the chain 5. The proper lifting force and rearward force is determined by the coupling procedure. As the plow frame 4 is first lifted by the chain 5 there should be enough friction remaining in the contact of the scraper blade 2 with the ground to prevent the plow assembly from sliding rearward. The only effect at first is that plow frame 4 is raised.

With the plow frame 4 raised there will be less weight on the scraper blade 2. This will allow the operator to move the plow assembly 1 around to align the plow frame ears 16 with the vehicle frame ears 11. This is the most difficult task with conventional plows. When the ears 16, 11 are roughly aligned, the operator will raise the plow further. This forces the plow frame ears 16 into the socket formed by the vehicle frame ears 11, the vehicle frame 13, and the metal stop 10. The plow 1 can be raised off the ground and the ears 11, 16 will remain in alignment. The operator can easily insert the coupling pins 21 and the plow mating job is done. Decoupling is equally easy; raise the plow 1, remove the pins 21, lower the plow 1, and disconnect the chain 5.

The forces that act on the plow frame during coupling must be adjusted for optimum results. The raising force is determined by the chain attachment point 18, the position of the plow's center of gravity 15, and the weight of the plow. As the chain attaching point 18 is moved closer to the center of gravity 15 the plow frame 4 raising force is reduced.

The rearward force is determined by the angle 26 of the lifting chain. If the lifting chain is vertical there will be no rearward force as the plow frame is lifted. As the angle is increased the rearward force is increased. The force should be sufficient to hold the plow frame ears 16 into the vehicle frame ear assembly 11, 10, 13. If the rearward force is too great then the plow assembly 1 will slide back toward the vehicle without lifting the plow frame 4. This would make mating the plow very difficult. The angle of the chain 26 is changed by adjusting the length of the lifting lever 7.

I claim:

1. A coupling apparatus for removably mating a snow plow with a vehicle comprising:

a first ear with a coupling pin hole and having a specific radius from the coupling pin hole to a curved outer portion of the first ear, said first ear being attached to one of the snow plow and the vehicle;

a second pair of ears with coupling pin holes, said second pair of ears being attached to the other of the snow plow and vehicle; and a stop and a frame bar attached to both ears of said second pair of ears for receiving said first ear, said stop and said frame bar being positioned at a distance equal to the specific radius from the center of the coupling pin holes, thereby allowing proper alignment of the coupling pin holes during mating.

2. The coupling apparatus of claim 1 further including a coupling pin for insertion through said coupling pin holes to secure the first ear to the second pair of ears.

3. The coupling apparatus of claim 1 wherein said curved outer portion of the first ear is semicircular in shape.

4. The coupling apparatus of claim 1 in which said second pair of ears is attached to the vehicle.

* * * * *